US007395139B2

(12) United States Patent
Burton et al.

(10) Patent No.: US 7,395,139 B2
(45) Date of Patent: Jul. 1, 2008

(54) CONDITION MONITORING SYSTEM

(75) Inventors: Colin Burton, Chippenham (GB); Stephen Baker, Mornington (AU); Jay Walser, Prospect, KY (US); Manus Henry, Headington (GB)

(73) Assignees: Westinghouse Rail Systems Limited, London (GB); Invensys Rail Systems Australia Limited, South Melbourne (AU); Safetran Systems Corporation, Louisville, KY (US); Invensys Systems Inc., Foxboro, MA (US); Westinghouse Brake And Signal Holdings Limited, London (GB)

( * ) Notice: Subject to any disclaimer, the term of this patent is extended or adjusted under 35 U.S.C. 154(b) by 781 days.

(21) Appl. No.: 10/477,222

(22) PCT Filed: May 8, 2002

(86) PCT No.: PCT/AU02/00570

§ 371 (c)(1),
(2), (4) Date: Apr. 19, 2004

(87) PCT Pub. No.: WO02/090166

PCT Pub. Date: Nov. 14, 2002

(65) Prior Publication Data

US 2004/0167686 A1 Aug. 26, 2004

(30) Foreign Application Priority Data

May 8, 2001 (AU) ..... PR4832
Feb. 12, 2002 (GB) ..... 0203262.1

(51) Int. Cl.
*G05D 1/00* (2006.01)

(52) U.S. Cl. ..... 701/19; 104/7.2

(58) Field of Classification Search ..... 701/19, 701/23, 36; 104/7.1–7.3; 246/3, 264–269
See application file for complete search history.

(56) References Cited

U.S. PATENT DOCUMENTS 3,771,119 A 11/1973 Evans (Continued)

FOREIGN PATENT DOCUMENTS

DE 33 30 869 A1 4/1985

(Continued)

OTHER PUBLICATIONS

Derwent Abstract Accession Nos. 00-139719, JP 11348788 (Nippon Signal Co. Ltd) Dec. 21, 1999 JP 2000112777 A (Nippon Signal Co Ltd) Apr. 21, 2000.

*Primary Examiner*—Richard M. Camby
(74) *Attorney, Agent, or Firm*—Young & Thompson

(57) ABSTRACT

A system is disclosed for monitoring condition of a railways installation such as a points machine. The system includes a plurality of sensors ($S_1$, $S_2$, $S_3$-$S_N$) associated with elements of the installation for monitoring parameters indicative of operating capability of the installation. The system includes means (12, 23) for processing the monitored parameters to determine whether the parameters are changing relative to reference values and to determine whether the changes are indicative of an increased risk of malfunction in the installation. The processing means may include a digital computer programmed with condition monitoring and fault detection software. A method of monitoring condition of a railways installation is also disclosed.

24 Claims, 4 Drawing Sheets

U.S. PATENT DOCUMENTS

| | | | | |
|---|---|---|---|---|
| 4,283,031 | A | | 8/1981 | Finch |
| 4,325,524 | A | | 4/1982 | Krug |
| 4,860,971 | A | * | 8/1989 | Allen ..... 244/122 AD |
| 5,172,637 | A | * | 12/1992 | Theurer et al. ..... 104/7.2 |
| 5,253,830 | A | | 10/1993 | Nayer et al. |
| 5,803,411 | A | | 9/1998 | Ackerman et al. |
| 5,806,809 | A | | 9/1998 | Danner |

FOREIGN PATENT DOCUMENTS

| | | | |
|---|---|---|---|
| DE | 35 11 891 | A1 | 10/1986 |
| DE | 35 15 962 | A1 | 10/1986 |
| DE | 35 40 307 | A1 | 5/1987 |
| DE | 36 08 878 | A1 | 6/1987 |
| DE | 36 12 652 | A1 | 10/1987 |
| DE | 36 37 037 | A1 | 5/1988 |
| DE | 42 03 233 | A1 | 7/1993 |
| DE | 196 06 894 | A1 | 8/1997 |
| DE | 196 06 895 | A1 | 8/1997 |
| DE | 198 26 269 | A1 | 12/1999 |
| DE | 198 38 672 | A1 | 3/2000 |
| EP | 0 514 365 | A2 | 11/1992 |
| FR | 2 745 543 | | 9/1997 |
| GB | 2 313 611 | | 12/1997 |
| GB | 2 335 986 | | 10/1999 |
| JP | 197 47 198 | A1 | 4/1999 |
| JP | A 11-208478 | | 8/1999 |
| JP | A 11-348788 | | 12/1999 |
| JP | A 2000-62612 | | 2/2000 |
| WO | 90/12411 | | 10/1990 |
| WO | 97/33784 | | 9/1997 |
| WO | 00/10860 | | 3/2000 |

* cited by examiner

| Sensor Ref | Location | Record | Type |
|---|---|---|---|
| A | Point M/c Drive Rod | Drive load/Thrust | Load Cell Strain Gauge |
| B1,B2 | Detector Rods within point M/c | Linear displacement Det. Rods to M/c | Inductive Analogue |
| C1,C2 | Facing Point Lock within point M/c | Linear displacement Lockblades to M/c | Inductive Analogue |
| D1 | Left Hand Switch Rail | Linear Displacement LH Switch `Closed` | Inductive Analogue |
| D2 | Left Hand Switch Rail | Linear Displacement LH Switch `Open` | Inductive Analogue |
| D3 | Right Hand Switch Rail | Linear Displacement RH Switch `Open` | Inductive Analogue |
| D4 | Right Hand Switch Rail | Linear Displacement RH Switch `Closed` | Inductive Analogue |
| E | Point Machine Casing | Linear Displacement M/c relative to track | Inductive Analogue |
| F | Point Machine Main Cover | Cover movement Open/Closed | Mech micro switch |
| G | Hand Crank | Hand Crank insertion/removal | Mech micro switch |
| H | Motor Control | Circuit integrity | 100W Thick Film Res |
| I(nor) | Motor Control | Motor Current & Voltage driving `Normal` | Resistor -4 Wire |
| I(rev) | Motor Control | Motor Current & Voltage driving `Reverse` | Resistor -4 Wire |
| J | Point Machine | Surface Temperature | Thermistor |
| K | Rail | Surface Temperature | Thermistor |

FIG 4

CONDITION MONITORING SYSTEM

The present invention relates to condition monitoring and in particular relates to a system for monitoring condition of a railways installation such as a points machine. The system includes a distributed array of sensors adapted to gather data regarding the status of elements of the installation with which the sensors are associated. The monitoring system may utilize advanced algorithms to process the data for a variety of purposes including predicting failure of equipment, developing efficient maintenance schedules and managing railway assets in general.

Although monitoring of a railway installation such as a points machine is known, prior art monitoring has been of a limited scope and typically has been limited to measurement of displacement to confirm that a switched rail has moved to a position sufficiently close to a stock rail to ensure safe operation. Prior art monitoring generally has been useful for detecting faults in infrastructure subsequent to failure of the monitored elements.

Analysis of points machine faults reported over a five year period has shown that significant fault modes are not failures of the points machine itself (e.g. motor problems), but are due to problems with mechanical alignment of the monitored installation, including the track. The monitoring system of the present invention may provide reasonably comprehensive monitoring of this mechanical alignment. If a problem occurs, irrespective of the underlying cause (e.g. different types of obstruction, ballast movement, increased slide chair friction, mechanical looseness of various types), it should be visible via one or more sensors; conversely, if the relationship between all sensor signals is normal, this may be strong evidence that the mechanical alignment of the monitored installation is sound.

Consideration may be given as to how and more precisely when problems may manifest themselves. It is a well-established principle of validation that faults in a system are more readily diagnosed when it is undergoing stimulation, rather than when it rests in stasis. Of course the most obvious system stimulation occurs when the points are thrown, and naturally all points condition monitoring systems are active when this happens. Even so, a sparsely instrumented condition monitor which only observes, say, current, voltage and load force, is less likely to observe a loose stock rail than one which monitors stock rail movement directly.

An object of the present invention is to provide a tool for railways to prevent or at the very least to reduce interruptions to service caused by failures to equipment. Another object of the present invention is to provide a system which may monitor a plurality of measurements for the purpose of validating proper functioning of a points machine and its associated track. A further object is to provide means for enabling maintenance schedules and work to be planned and undertaken with greater efficiency.

According to one aspect of the present invention there is provided a system for monitoring condition of a railways installation such as a points machine, said system including:

- a plurality of sensors associated with elements of said installation for monitoring parameters indicative of operating capability of said installation; and
- means for processing said monitored parameters to determine whether said parameters are changing relative to reference values and to determine whether the changes are indicative of an increased risk of a malfunction in said installation.

According to a further aspect of the present invention there is provided a method of monitoring condition of a railways installation such as a points machine said method including the steps of:

- monitoring with a plurality of sensors parameters indicative of operating capability of said installation; and
- processing the monitored parameters to determine whether said parameters are changing relative to reference values and to determine whether the changes are indicative of an increased risk of a malfunction in said installation.

The condition monitoring system of the present invention includes a plurality of sensors for acquiring trackside data related to a plurality of different parameters and for logging key events. The sensors are connected or associated with elements of the installation (eg. points) being monitored. The sensors may be adapted to acquire data for several quantities or classes of parameters including force, power, current/voltage, spatial measurements including distance or displacement, electrical noise, temperature and state changes. In a specific embodiment sensors associated with the monitoring system may be adapted to measure one or more of: load force; switch blade position on each side thereof; motor voltage and current during operation; track and points machine temperature; lock and detection blade position on each side thereof; stock rail position on each side thereof; and points machine position (relative to a fixed point). The monitoring system may utilize information relating to at least two, and preferably at least three of the aforementioned parameters. Key events to be logged may include time stamping of points operation, opening and closing of case cover associated with a points machine, insertion and removal of a hand-crank, loss of supply current and passage or transit of a train.

Force measurement may be associated with movement of slide chairs, or may be indicative of an obstruction, clutch slip and/or snow obstruction. Sensors for performing force measurement may include a load cell or load pin and/or a strain gauge or gauges.

Sensors for performing distance or displacement measurements may include inductive analog proximity transducers. At the toe of each point there may be one or more proximity sensors for measuring closed blade gap, stock rail position and machine position. Sensors for monitoring the case cover and hand crank may include a micro switch. Temperature sensors may include thermistors or semiconductor devices. External radiation temperature may be measured directly. Motor current sensors may include Hall Effect instantaneous current transducers.

Measurements may be made and monitored in respect of electrical properties associated with a circuit controller, high resistance contacts in relays, high resistance contacts in hand crank cut-out and motor brushes/commutator.

The monitoring system may include an analog interface for interfacing the sensors to processing means. The analog interface may include signal conditioning and buffering circuits. The system may include a plurality of analog to digital converters and a logic array for collecting data and forwarding to the processing means. The logic array may perform some preliminary processing. The processing means may include a suitably programmed digital computer such as a PC system.

The logic array may be provided in the form of a field programmable gate array (FPGA). The FPGA may continuously monitor the plurality of sensors and pass data to the PC system for processing and storage. The FPGA may collect data from the plurality of sensors at a relatively low speed in normal mode (eg 500 Hz). Upon detecting an event such as a point movement or a train transit, the FPGA may switch to a relatively high speed mode (eg. 2.5 KHz) whilst focussing on a subset of the plurality of sensors. The subset of sensors selected as a focus for that high speed monitoring may be selected between one of two or more sub-sets having regard to the nature of the detected event.

The PC system may be provided on a single board (eg. PC104 module). The PC system may store a snapshot of the monitored system periodically, typically between every one and fifteen minutes, for example approximately every 4 minutes, and store this locally for use in on-line (ie, real time) trend analysis. The PC system may also archive data for later (off line) processing and analysis.

Off-line or on-line processing and analysis may be conveniently carried out by means of a condition monitoring and fault detection software toolkit.

Abnormal system operation may be detected by means of algorithms operating in distinct modes including modes such as those now described:

A threshold limit mode may detect when a monitored parameter exceeds a threshold value beyond which the points are considered to have failed. On reaching one or more of these threshold values an alarm condition may be triggered.

A rate of change mode may give consideration to any parameter that is changing in such a way that extrapolation would show that it will exceed a threshold value in a given time period.

A signature mode may monitor signature of each parameter over time or events. The signature may change over time. A change in the signature at a rate greater than that expected may be utilized to provide an indication of a potential failure.

A behaviour mode may make use of a series of models of known behaviours. The models may be generated by means of a test site for simulating a range of failures. Signatures of the behaviour may be modelled and used to predict such failures or as a tool to assist diagnosis of failures.

A correlation mode may compare changes in status of parameters from different reference planes. The changes in parameters may be expected to move in unison, or other defined relationship, and any departure from this may be interpreted to indicate a possible failure. The correlation mode may provide an indication of changes to the mechanical alignment of the monitored installation.

By monitoring parameters before and after maintenance it may be possible to gauge effectiveness of the maintenance and to confirm that the maintenance was necessary. It may also be possible to determine when to perform maintenance. As the monitoring system is capable of returning numerical data, the system may also act as a measurement tool to assist in maintenance functions.

Situations in which detailed observation and analysis of points behaviour can provide additional diagnostic data include post-movement relaxation and train transits.

It has been observed that in the aftermath of a points machine movement, there is a gradual change in various positions and load force, as the machine settles down over the following ten minutes or so. The extent of such relaxation may give an indication of how firmly the machine and the points are secured. Any looseness may show itself as a much greater shift in load force or position. Thresholds may be established for permitted levels of relaxation which, if exceeded, can trigger alarms requesting maintenance action.

If the points machine and its associated track are viewed essentially as a mechanical system where each of the parts must stay in correct alignment for proper functioning, then it is found that the transit of a train, with the corresponding huge injection of mechanical energy into the system, provides a valuable opportunity for testing fastness of the mechanical alignment. For example data which follows train movements may be recorded as they occur up to ten minutes after a points machine movement. The rattling and sometimes the shift in value caused by the train are clearly superimposed upon the post-movement relaxation trends described above. A contrast can be drawn between a site where there is little or no shift in signal values before and after a train event, and one where relatively large and permanent shifts in value may occur.

The behaviour of the points machine and its associated track during a train passage may provide valuable extra information on how securely the mechanical system is fixed. It is a straightforward matter to set alarm limits on the extent of such shifts, or the standard deviation (extent of rattle) of the signals during a train transit. Trending may also be deployed to see how such parameters vary with time. An important issue is deciding at what level thresholds should be set.

Stored reference data regarding selected parameters of the plurality of parameters may be updated with detected changes in those parameters (when those changes are within predetermined acceptably limits), such as are for example typical of normal wear or aging. The updated reference data may then be employed as a reference point for monitoring whether subsequent changes or rate of change of those parameters are indicative of the occurrence for a heightened risk of a malfunction.

The monitoring system may feature use of fixed thresholds or stored reference data for one or some of the parameters, e.g. parameters such as closure gap distance which are potentially safety critical.

The processing means may include a digital computer programmed with condition monitoring and fault detection software. The software may be adapted to monitor behavioural trends. For example it may monitor trends which occur within a defined range of parameters and may provide that changes represented by those trends are used to create an updated reference point relative to which the system may then monitor for any higher rate of change or change of absolute level which would indicate the occurrence of or a heightened risk of a malfunction.

The system may include an interface to a communications network such as the internet. At least some processing modes as outlined above may be performed on-line via the PC system to provide trend analysis. The numerical data and on-line analysis may be available via the communications network to allow an operator to 'see' what is happening at the points and make value judgements based on that information.

The monitoring system may provide information through its communication interface and off line reports to the operator to diagnose an event. By providing real time physical data the system may serve as a valuable maintenance tool by providing service adjustment information from the monitored equipment.

Moreover, by utilizing analysis tools as described herein the monitoring system may predict possible failure and/or provide suitable warnings of impending failure. A capacity to predict a future condition of the monitored equipment may facilitate determination of when maintenance needs to be performed as well as the type of maintenance to be performed.

An exemplary embodiment of the present invention is described below with reference to the accompanying drawings in which:

FIG. 4 shows a table of the sensors in FIG. 3.

Figure 1:
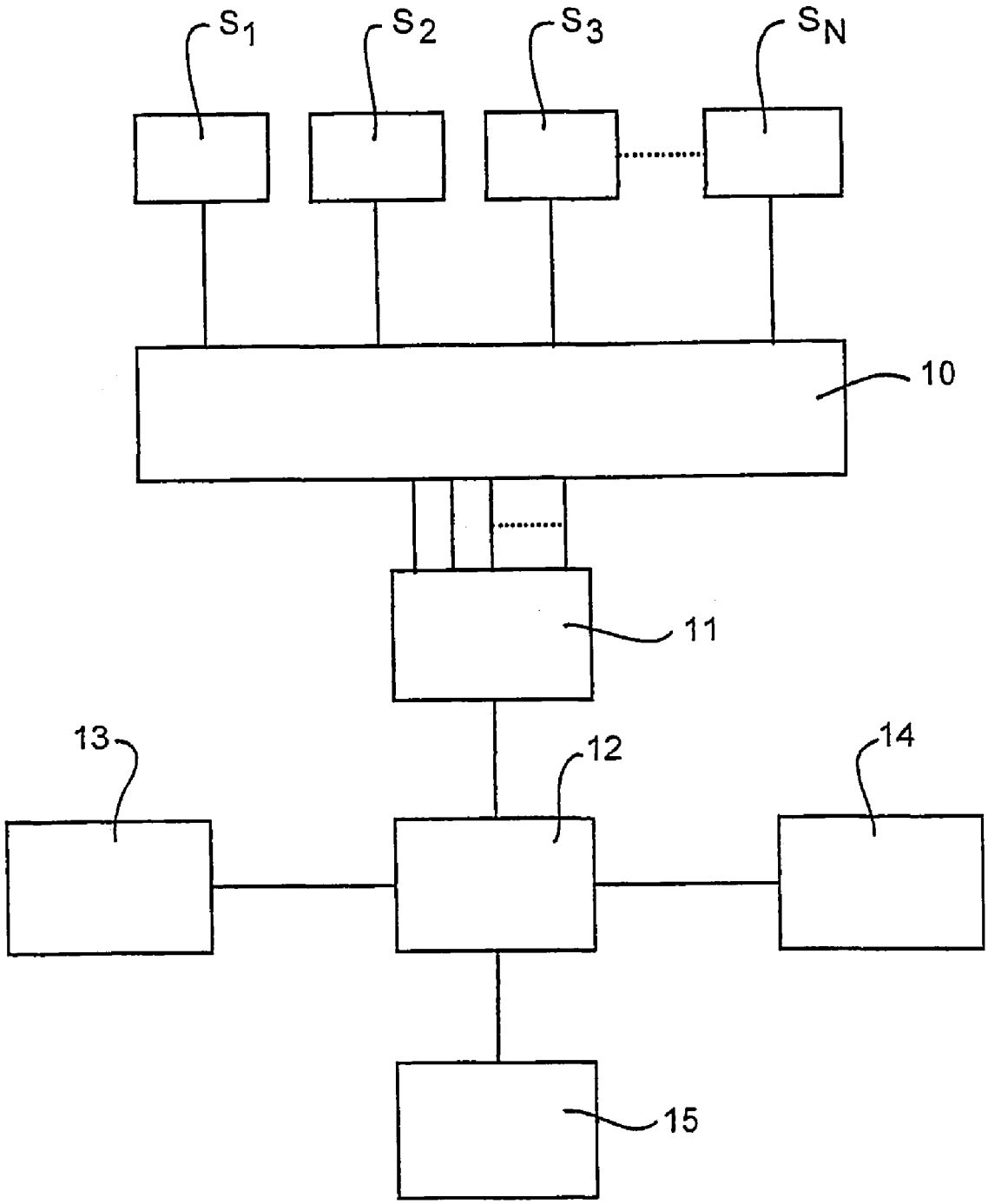
FIG. 1 shows a block diagram of a condition monitoring system according to the present invention.

Referring to FIG. 1, a plurality of sensors. $S_1$ to $S_N$ is associated with elements of a railway infrastructure. Sensors $S_1$ to $S_N$ are adapted to measure plural quantities or classes of parameters including force, displacement, current, voltage, temperature, electrical noise, state changes etc . . . Sensors $S_1$ to $S_N$ are connected to analog interface module 10. Interface module 10 includes signal conditioning and buffering circuits. The outputs of analog interface module 10 are connected to Analog to Digital (ADC) converter module 11. ADC module 11 is adapted to convert analog data gathered by sensors $S_1$ to $S_N$ to a digital domain. Digital data from ADC module 11 is passed to processing module 12.

Processing module 12 may include a logical array such as an FPGA for performing preliminary processing of data. Processing module 12 may include a digital computer such as a suitably programmed PC system for performing on-line (ie real time) processing of data. If appropriate, the processing module may be partitioned so that preliminary processing may take place within an FPGA in one location (for example within the railway equipment), while further processing takes place remotely in a separate processor, with data communication taking place over a suitable link between the FPGA and processing module. In one instantiation, a single processing module may be linked up with several FPGA modules, each of which is associated with a separate piece of railway equipment.

The system includes a storage module 13 for archiving data. Archived data may be processed off-line via suitable analysis software. The monitoring system may be connected to a local or wide area network via network interface module 14. The system may also include a display/keyboard module 15 for providing a user interface to the monitoring system. Alternatively, a laptop or palmtop device may communicate with the monitoring system via its network capability, to act as a local terminal.

Figure 2:
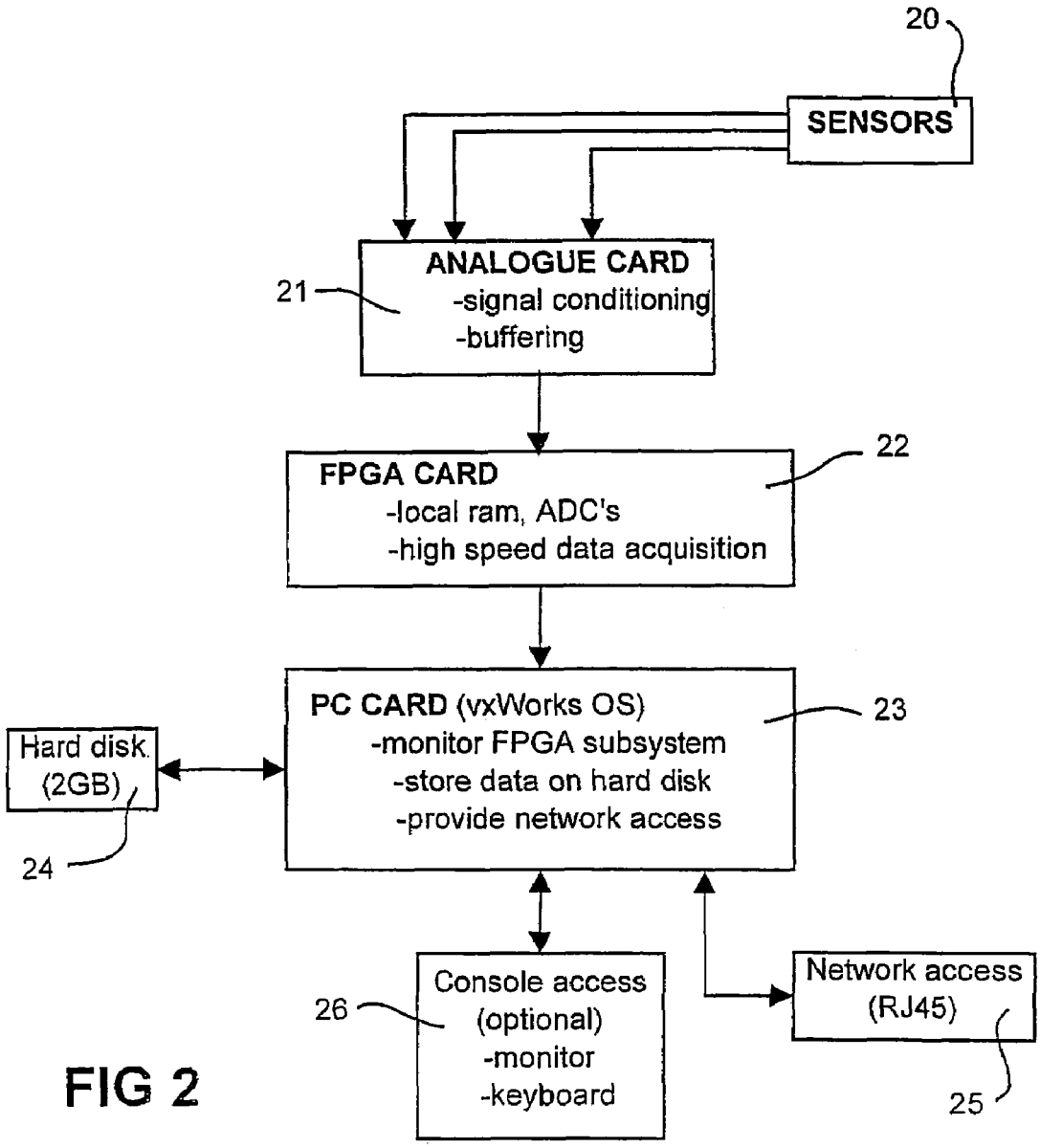
FIG. 2 shows one embodiment of the condition monitoring system of FIG. 1.

FIG. 2 shows an exemplary embodiment of the monitoring system including an array of sensors 20. The array of sensors 20 monitors a variety of parameters and parameter types including displacement, current, voltage, temperature and state changes. Optionally duplicate sensors may be provided for at least some of the parameters, especially any sensors that are of a less reliable type.

Figure 3:
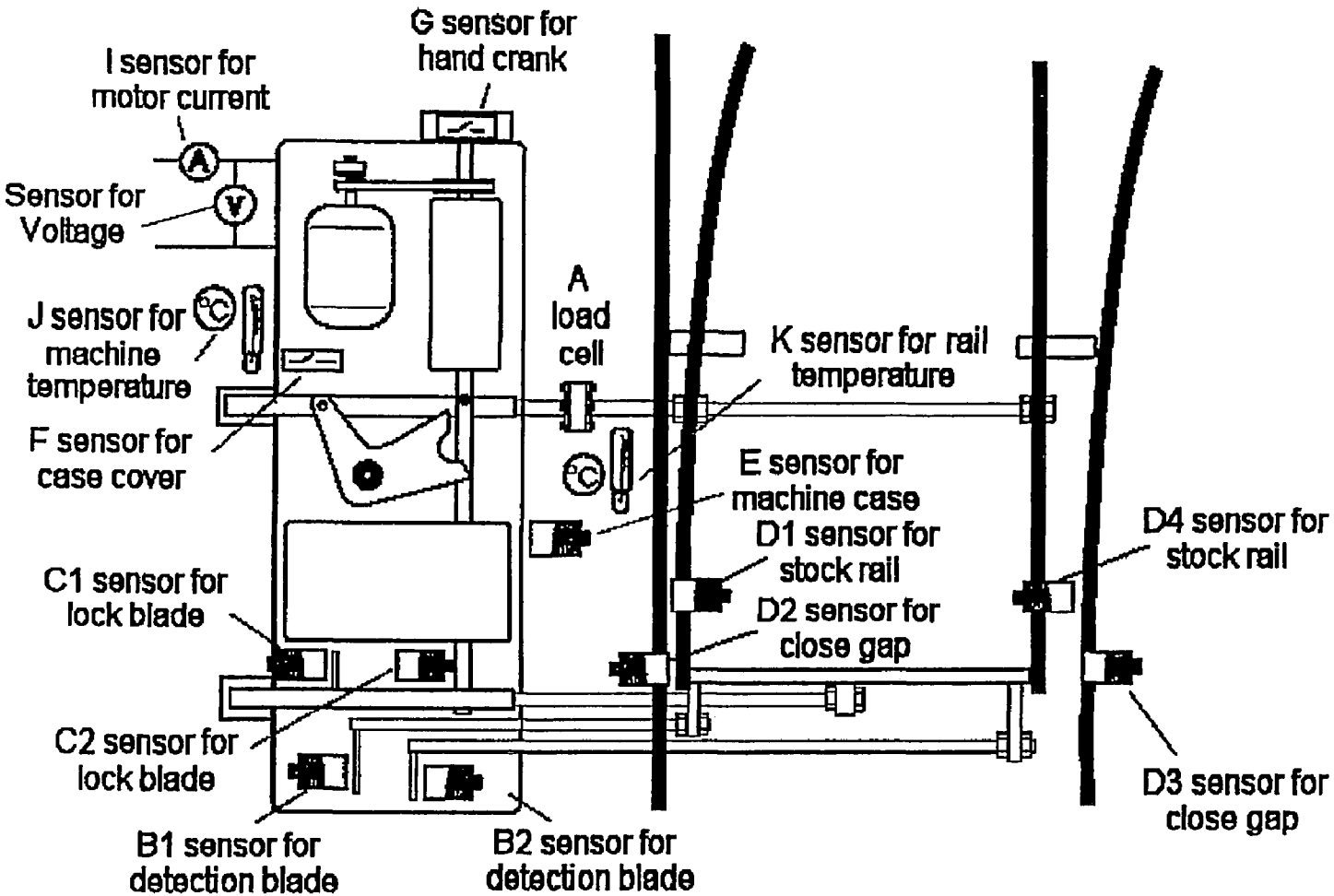
FIG. 3 shows the disposition of sensors relative to a points machine.

The disposition of sensors relative to a points machine is shown in FIG. 3. A table of the sensors in FIG. 3 is set forth in FIG. 4. Analog signals from sensors 20 are connected to analog interface card 21 for providing signal conditioning and buffering of the analog signals. The conditioned and buffered signals are passed to FPGA card 22. FPGA card 22 includes a plurality of ADCs, local RAM as well as a Xilinx 4085 chip FPGA for controlling and gathering data from the ADC's. Each ADC may include a sigma delta analog to digital converter. The local RAM may include 256K×16 SRAM. The FPGA averages the data and stores it in the local RAM making it available to PC card 23 upon request. The FPGA is a resource of approximately 85,000 logic gates, which can be dynamically configured and connected under software control. Functionality within the FPGA is determined by a configuration file, which must be loaded before the FPGA can perform its desired functions.

The configuration bitstream which defines the functionality of the FPGA can be loaded under the control of a host, into the FPGA. The bitstream for the FPGA originates from a "HandelC" source file. This describes the desired functionality using a C-like syntax, but it is complied into a list of hardware requirements by the HandelC compiler, rather than processor instructions. The netlist which results from this compilation is then processed by the Xilinx toolset, into a bitstream suitable for downloading into the FPGA by a host.

The FPGA continuously monitors sensor array 20 and passes data each second to PC card 23 for further action. The FPGA carries out the following functions in the current embodiment:

It communicates to the PC processor over a PC104 bus, updating the PC on the status of the points machine, accepting and responding to commands from the PC, and sending data to the PC on request.

It controls the buffering of data in the local RAM memory until the PC is ready to receive it, thus relieving the PC of responsibility for time-critical operations.

It controls analog-to-digital converters (ADCs), these being Analog Devices' AD7731s. These are so-called sigma-delta converters with a high degree of programmability. For each ADC, any one of up to 3 input channels can be monitored; the sampling rate, input gain(e.g. multiply the input signal by 1, 2, 4, 8 . . . ), and output word precision (e.g. 16 or 24 bits) can all be configured. In the current embodiment, the ADCs are used to monitor a total of 18 input channels under FPGA control, each having up to 3 distinct inputs.

In a default (background) mode of operation the FPGA monitors all 18 channels in turn. The ADCs are continuously reprogrammed in parallel to read each of their 3 input channels in turn. This results in a sampling rate of approximately 500 Hz on all channels. The FPGA carries out some simple signal conditioning, and saves the resulting data in a compact form so that the PC can read the channel data at a rate of only 1 Hz.

Each time new data is read, the FPGA checks to see whether a new 'event' has begun, such as a points machine movement including post movement relaxation or a train passage or transit. If so, the FPGA indicates to the PC that a new event has begun and reprograms the ADCs to carry out a different data acquisition scheme. For example, during a points machine movement only five channels are sampled, but at 2.5 kHz per channel. The data are stored in the local RAM memory for transmission to the PC once the event is completed. If desirable, further data processing (e.g. data compaction) can be carried out to reduce the volume of data sent to the PC. On completion of the event, a normal background pattern of data acquisition is resumed.

Upon detecting an event such as point movement or passage of a train the FPGA switches into a high speed data acquisition mode for a subset of the sensor array. It passes all of its data to PC card 23 for processing and storage. PC card 23 includes a PC104 Form factor PC. This is a complete PC system comprising memory, I/O, etc, in a footprint of ~90 mm×96 mm and is a commercially produced product. The operating system used is VXWorks from Windriver. The "PC104 expansion bus" is in effect a PC ISA bus in a different form factor, allowing vertical "stacking" of expansion boards, rather than conventional motherboard "slots".

PC card 23 stores samples of data every 4 minutes in Local Storage for use in an on line trend analysis. Data is also archived on flash disk 24 for off-line processing and analysis.

The system includes network access module 25 for interacting with a wide area network such as the internet. Console access module 26 including a monitor and a keyboard provides an interface to a human operator.

A variety of analysis techniques may be used to detect significant changes in equipment behaviour, including the following:

Threshold Limit Mode

In this mode each of the parameters may have a threshold limit beyond which the points are considered to have failed. On reaching one or more of these values an alarm may be given.

Rate of Change Mode

In this mode consideration may be given to any parameter that is changing in such a way that extrapolation would show it exceeding a threshold limit in a given time period.

Deviation from Expected Behaviour Mode

All parameters generate a signature over a period of time or events. This signature may change over time. A change in this signature at a rate greater than expected may indicate a possible failure.

Behaviour Model Mode

Using a test site a series of known behaviours and results from failures may be simulated. This signature of these behaviours may be modelled and used to either predict the failures or be used as a tool to assist in the diagnosis of failures.

Correlation of Parameters Mode

As a number of sensors are applied to the points, some are capable of showing the same changes in status but from different reference planes. These parameters may be expected to move in unison and any departure from this may indicate a possible failure.

One possible means of carrying out such data analysis, whether offline or online is by means of condition monitoring and fault detection (CMFD) software designed to have as one of its main objectives the detection of abnormal operation and subsequent diagnosis of identification of contributing factors leading to abnormal operation. The CMFD software may operate with a real-time control engine to provide on-line status information about the monitored operation. Two of the technologies that the CMFD software may provide include data compression and modelling algorithms.

One data compression algorithm is Principal Component Analysis (PCA). PCA examines many variables and identifies key correlations between them. It then generates a much smaller set of variables, called 'principal components', which retain the majority of the information contained in the original measurements. The relationship between new measurements and the generated components can be monitored to detect a change in the underlying relationships that govern the railway equipment.

A second data compression algorithm is called Partial Least Squares (PLS), and uses Least Squares (LS) type modelling to identify a relationship between inputs and outputs. It too compresses the variables, but unlike PCA it differentiates between inputs and outputs. Internal variables, known as 'latent variables', are modelled using a variation of LS modelling, and can be monitored in order to detect changes in operation. Cross validation may be included for both these algorithms to aid selection of components and latent variables.

In real-time operation, for both PCA and PLS, the CMFD software may be employed to fill-in for missing data to allow process condition monitoring to continue even if individual signals are lost. Traditional Model-Based Statistical Process Control indicators such as the $T^2$ and Q statistics may also been included. These may be derived directly from the PCA and PLS engines, and are established quality measures. Two characterisation engines may be included that allow the user to detect abnormal process operation, namely Elliptical Density Estimation (EDE) and Kernel Density Estimation (KDE). Both EDE and KDE may use historical data from the process to form a definition of 'normal' process operation. These algorithms may be used in conjunction with PCA or PLS to further enhance the capability of the CMFD software to detect abnormal operation.

Multiple condition monitors may be run side-by-side in real-time, or a single condition monitor may support a number of different model sets. In this latter configuration, a degree of automatic process classification may be possible based on the PCA/PLS models and the analysis of clusters.

The processing analysis may be adapted for detecting abnormal system operation as well as subsequent diagnosis and identification of contributing factors leading to abnormal operation.

Because parameters are monitored before and after maintenance the analysis may provide an indication of the effectiveness of the maintenance and/or whether the maintenance was in fact necessary. The analysis may also determine when maintenance is to be performed. Maintenance functions may be assisted because the monitoring system is capable of returning numerical data and may thereby act as a measurement tool.

Because the system may provide data through its web interface continuously, it is possible to "see" what is happening at the points and to make value judgements based on the information. Through the network interface and off-line reports the monitoring system may provide information to the maintainer to diagnose an event. By providing real time physical data the system may be able to give the maintainer adjustment information for the installation. By using all the analysis tools described above it may be possible for the system to predict possible failure and to provide a suitable pre-warning. As the system includes an ability to predict a possible future condition of the equipment it is possible to determine when maintenance will be needed and what type of maintenance is to be performed.

It is to be understood that the invention described hereinabove is susceptible to variations, modifications and/or additions other than those specifically described and that the invention includes all such variations, modifications and/or additions which fall within the spirit and scope of the above description.

The invention claimed is:

1. A system for monitoring condition of a railways installation such as a points machine, said system including:

a plurality of sensors associated with elements of said installation for monitoring parameters indicative of operating capability of said installation; and means for processing said monitored parameters to determine whether said parameters are changing relative to reference values and to determine whether the changes are indicative of an increased risk of a malfunction in said installation, wherein said sensors are adapted to monitor at least one of lock and detection blade position on each side thereof, stock rail position on each side thereof, and points machine position relative to a fixed point.

2. A system according to claim 1, wherein the changes in said parameters include a rate of change of one or more of said parameters.

3. A system according to claim 1, wherein said monitored parameters are used to update said reference values within predetermined limits.

4. A condition monitoring system according to claim 1, wherein said parameters include two or more of force, power, distance or displacement, temperature, state changes and electrical properties including resistance, current, voltage and electrical noise.

5. A condition monitoring system according to claim 1, wherein said sensors are additionally adapted to monitor at least one or more of load force, switch blade position on each side thereof, motor voltage and current during operation, and track and points machine temperatures.

6. A condition monitoring system according to claim 5 wherein a sensor for measuring load force is associated with slide chairs in said installation.

7. A condition monitoring system according to claim 5 wherein a sensor for measuring voltage and/or current is associated with an electric motor in said installation.

8. A condition monitoring system according to claim 1 including means for interfacing said sensors to said processing means, said interfacing means including signal conditioning and buffering circuits, analog to digital converters and a logic array.

9. A condition monitoring system according to claim 8 wherein said logic array includes a field programmable gate array (FPGA).

10. A system according to claim 9 wherein said FPGA is switched to a relatively high speed mode of data acquisition upon detecting an event such as a points machine movement or a train transit.

11. A condition monitoring system according to claim 1 wherein said processing means includes a digital computer programmed with condition monitoring and fault detection software.

12. A condition monitoring system according to claim 11 wherein said software includes at least one algorithm operating in one or more of a threshold limit mode, a rate of change mode, a deviation from expected behaviour mode, a behaviour model mode and a correlation of parameters mode.

13. A method of monitoring condition of a railways installation such as a points machine said method including the steps of:

monitoring with a plurality of sensors parameters indicative of operating capability of said installation; and processing the monitored parameters to determine whether said parameters are changing relative to reference values and to determine whether the changes are indicative of an increased risk of a malfunction in said installation, wherein said sensors are adapted to monitor at least one of lock and detection blade position on each side thereof, stock rail position on each side thereof, and points machine position relative to a fixed point.

14. A method according to claim 13, wherein the changes in said parameters include a rate of change of one or more of said parameters.

15. A method according to claim 13, wherein said monitored parameters are used to update said reference values within predetermined limits.

16. A method according to claim 13, wherein said parameters include two or more of force, power, distance or displacement, temperature, state changes and electrical properties including resistance, current, voltage and electrical noise.

17. A method according to claim 13, wherein said sensors are additionally adapted to monitor at least one or more of load force, switch blade position on each side thereof, motor voltage and current during operation, and track and points machine temperatures.

18. A method according to claim 17 wherein a sensor for measuring load force is associated with slide chairs in said installation.

19. A method according to claim 17 wherein a sensor for measuring voltage and/or current is associated with an electric motor in said installation.

20. A method according to claim 13 including interfacing said sensors to a processing means by means of signal conditioning and buffering circuits, analog to digital converters and a logic array.

21. A method according to claim 19 wherein said logic array includes a field programmable gate array (FPGA).

22. A method according to claim 21 including switching said FPGA to a relatively high speed mode of data acquisition upon detecting an event such as a points machine movement or a train transit.

23. A method according to claim 13 wherein said processing is performed by means of a digital computer programmed with condition monitoring and fault detection software.

24. A method according to claim 23 wherein said software includes at least one algorithm operating in one or more of a threshold limit mode, a rate of change mode, a deviation from expected behaviour mode, a behaviour model mode and a correlation of parameters mode.

* * * * *